US005661484A

United States Patent [19]

Shumaker et al.

[11] Patent Number: 5,661,484

[45] Date of Patent: Aug. 26, 1997

[54] MULTI-FIBER SPECIES ARTIFICIAL DIELECTRIC RADAR ABSORBING MATERIAL AND METHOD FOR PRODUCING SAME

[75] Inventors: Gene P. Shumaker; Walter B. May, both of Orlando, Fla.

[73] Assignee: Martin Marietta Corporation, Bethesda, Md.

[21] Appl. No.: 675,809

[22] Filed: Jul. 5, 1996

Related U.S. Application Data

[63] Continuation of Ser. No. 250,354, May 27, 1994, abandoned, which is a continuation of Ser. No. 2,902, Jan. 11, 1993, abandoned.

[51] Int. Cl.[6] ..... H01Q 17/00

[52] U.S. Cl. ..... 342/1; 342/4

[58] Field of Search ..... 342/1, 2, 3, 4

[56] References Cited

U.S. PATENT DOCUMENTS

| | | | |
|---|---|---|---|
| 3,599,210 | 8/1971 | Stander | 343/18 |
| 4,725,490 | 2/1988 | Goldberg | 428/292 |
| 4,728,554 | 3/1988 | Goldberg et al. | 428/113 |
| 4,960,965 | 10/1990 | Redmon et al. | 174/102 |
| 5,003,311 | 3/1991 | Roth et al. | 342/4 |
| 5,081,455 | 1/1992 | Inui et al. | 342/1 |
| 5,085,931 | 2/1992 | Boyer, III et al. | 428/328 |
| 5,110,651 | 5/1992 | Massard et al. | 428/105 |
| 5,125,992 | 6/1992 | Hubbard et al. | 156/151 |
| 5,543,796 | 8/1996 | Thomas et al. | 342/4 |

*Primary Examiner*—J. Woodrow Eldred

*Attorney, Agent, or Firm*—Burns, Doane, Swecker & Mathis, L.L.P.

[57] ABSTRACT

In a radar absorbing material, first or relatively resistive fibers are combined with second or relatively conductive fibers in a dielectric binder. Preferably, the first fibers are graphite filaments and the second fibers are metal coated graphite filaments. The appropriate selection of fibers results in a material having broadband or multi-frequency RF absorbing properties.

21 Claims, 1 Drawing Sheet

MULTI-FIBER SPECIES ARTIFICIAL DIELECTRIC RADAR ABSORBING MATERIAL AND METHOD FOR PRODUCING SAME

This application is a continuation of application Ser. No. 08/250,354, filed May 27, 1994, abandoned, which is a continuation of Ser. No. 08/002,902 filed Jan. 11, 1993 abandoned.

This invention was made with Government support under Contract No. N00014-89-C-2221 awarded by the Department of Defense. The Government has certain rights in this invention.

FIELD OF THE INVENTION

The present invention relates generally to radar absorbing materials, and more specifically the invention relates to the design of a radar absorbing material having artificial dielectric properties achieved using fibers having different conductivities.

BACKGROUND OF THE INVENTION

A radar absorbing material (RAM) is a material which absorbs electromagnetic energy rather than reflecting it. Radar absorbing materials have obvious military applications, such as making aircraft, missiles and other equipment substantially less visible to radar. Radar absorbing materials also have commercial applications such as decreasing ghosting effects and unwanted clutter from structures interfering with airport radar systems and electromagnetic interference (EMI) control efforts on maritime vessels. Such commercial materials are available from companies such as the Plessey Company. Standard practice usually includes covering these objects with commercially available paste-on RAM materials. These materials can be difficult to apply and do not usually exhibit high-performance, multi-frequency radar absorption.

Commercially available materials typically include a single species of conductive filament with a specific length, diameter, conductivity and volume fraction within a dielectric binder to produce an absorber of limited bandwidth. Durability is also a major concern because commercially available RAM materials sometimes contain carbonyl iron powder (CIP) which oxidizes readily, if it is not totally encapsulated in an environmentally resistant binder.

A representative example of a prior art radar absorbing material is described in U.S. Pat. No. 3,599,210, entitled "Radar Absorptive Coating". U.S. Pat. No. 3,599,210 discloses a radar absorptive coating having conductive fibers cut to a length of one-half wavelength of the anticipated radar frequency. The fibers which may be formed of graphite are randomly dispersed in a lossy dielectric resinous binder. When radar signals impinge on the coating, the fibers act as tuned resonating dipoles for the particular radar frequency used, and the electromagnetic energy is dissipated in the lossy material.

Accordingly, there is a need for a more durable radar absorbing material having multi-frequency absorbing capabilities which can overcome the shortcomings of the known and commercially available radar absorbing materials.

SUMMARY OF THE INVENTION

The present invention provides a broadband radar absorbing material having relatively resistive fibers and relatively conductive fibers randomly dispersed in a dielectric binder.

The bandwidth of the absorber is determined by the relative conductivities of the fibers selected. The radar absorbing material of the present invention exhibits a significant bandwidth and RF absorption improvement over the prior art.

DETAILED DESCRIPTION OF THE INVENTION

The basic design approach of the present invention is to produce a radar absorbing material by combining light loadings of small diameter relatively resistive fibers such as T300 or AS-4 graphite with higher conductivity fibers such as solid stainless steel or nickel, copper or other metal coated graphite. The relative resistivity and conductivity of the fibers are determined by the specific application for the radar absorbing material. At least two different types of fibers are randomly dispersed in a low dielectric constant, low loss binder to produce a broadband artificial dielectric radar absorbing material. The present invention represents a significant improvement over conventional artificial dielectric materials that typically consist of ordinary low loss dielectric materials into which are dispersed a single type of small cylindrical, conductive filaments (electric dipoles) that radically modify the electrical properties (complex permittivity) of the ordinary dielectric.

Figure 1:
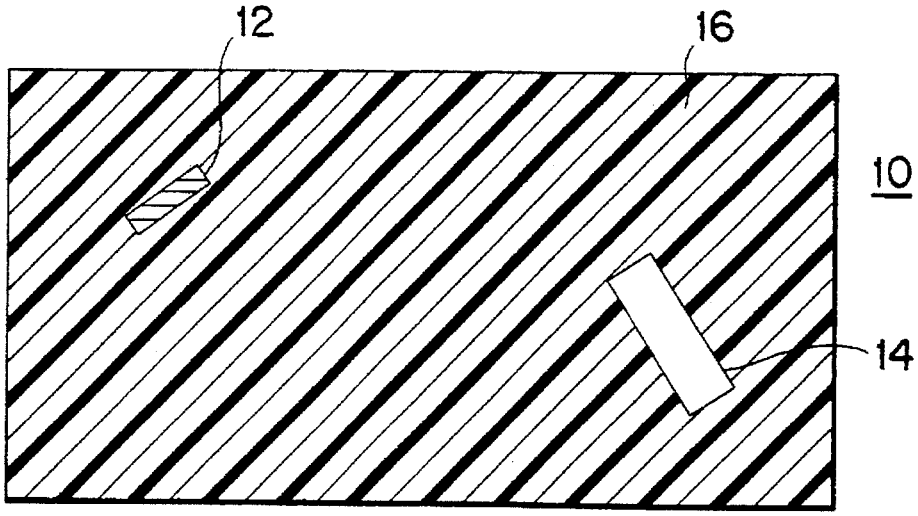
FIG. 1 is a cross sectional view of an artificial dielectric layer having conductive fibers of two different species.

Referring now to FIG. 1, there is a cross sectional view of an artificial dielectric layer 10 which includes a dielectric binder material 16, such as resin or polymer, and a plurality of conductive fibers of two different species 12, 14. The species 12 has different physical and electrical properties than the species 14.

Figure 2:
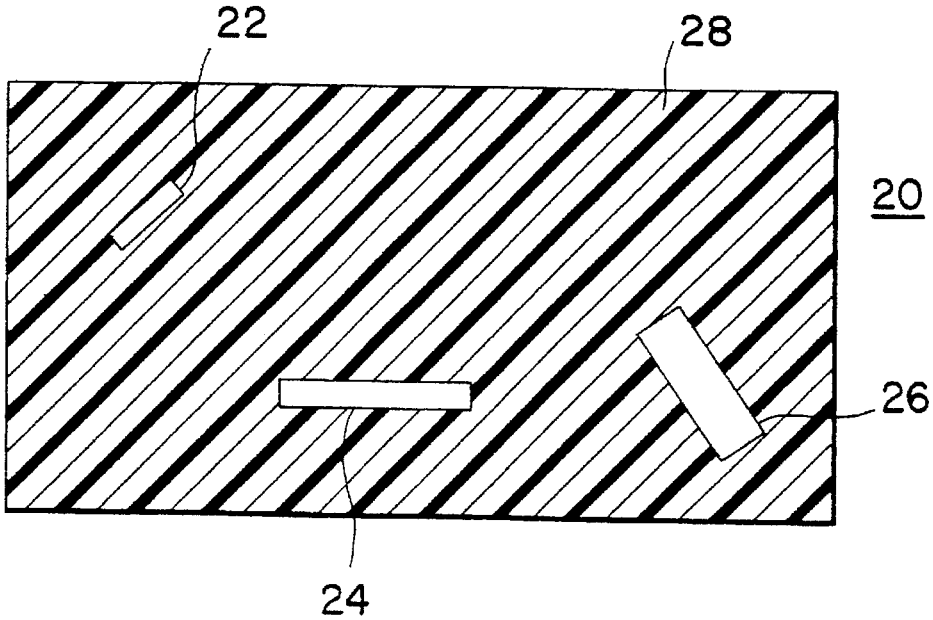
FIG. 2 is a cross sectional view of an artificial dielectric layer having conductive fibers of three different species.

Referring now to FIG. 2, there is a cross sectional view of an artificial dielectric layer 20 which includes a dielectric binder material and a plurality of conductive fibers of three different species 22, 24, and 26. Each fiber species will have unique physical and electrical properties selected to contribute to the overall efficiency of the artificial dielectric layer for absorbing the electromagnetic energy that is incident upon it.

The present invention permits frequency dependent, complex permittivities of materials to be produced by the proper selection of dipoles. The material is specially designed to produce a lossy material which is efficient at absorbing RF energy. The present invention, therefore, includes at least first and second fibers which are distinctly different filament species. Depending upon the specific application, the fibers will be cut to predetermined lengths. The different types of fibers are then combined into a single dielectric binder in order to produce the broadband or multiband RF absorber. Preferably the dielectric binder will have a permittivity of 1.5 to 3.0.

In the present invention, the relatively resistive fibers produce a Debye permittivity which is used to describe a material characterized as a relaxation oscillator, and the relatively conductive fibers produce a Lorentz permittivity which is used to describe materials with a damped harmonic oscillator resonance. Thus, the composite material of the present invention embodies the electrical properties of both these classical material types, and the present invention allows for the design of very efficient, broadband energy absorbing materials.

Since the conductive filament acts as a damped, harmonic oscillator, its length will be approximately equal to one half the wavelength (as observed in the binder dielectric containing the filament) of the median frequency of the incident energy in the frequency band whose energy is to be absorbed. The length of the conductive filament is not exactly one half a wavelength, since the conductive filament is not a perfectly conducting, harmonic dipole oscillator. The length of the conductive filament is preferably determined using a computer model which treats the conductive filament as the above mentioned damped harmonic oscillator.

The resistive filament does not have a resonant frequency like the conductive element. The length of the resistive filament is just one parameter in a determination of which frequency band or bands produce the maximum amount of loss for the incident energy. The length of the resistive filament is also preferably determined with the use of an appropriate computer model.

Lightweight, thin single layer broadband absorbers may, therefore, be designed with the first or relatively resistant filament producing a Debye permittivity and the second or relatively conductive filament producing a Lorentz permittivity. The present invention, however, is not limited to one fiber having a Debye characteristic and the other fiber having the Lorentz behavior. If different species of conductive filaments are used and each produces Lorentz permittivities at different resonant frequencies, the resulting material also yields a broadband or multiband RF absorber. It is also possible to use filaments having different Debye permittivities, but such a combination is less efficient. The complex permittivities of these bimodal artificial dielectrics, therefore, can be calculated using computer modeling techniques.

The fiber loaded radar absorbing material of the present invention can be produced in the form of sprayable materials or paste-on tiles for maximum application versatility. The active fibers are inert so they will not effect the environmental durability of the chosen binder system. The multi-fiber species design of the present invention adds multiband performance capability to a durable radar absorbing material.

While the invention has been described in its preferred embodiments, it is to be understood that the words used are words of description rather than of limitation, and that changes to the purview of the present claims may be made without departing from the true scope of invention in its broader aspects.

We claim:

1. An electromagnetic wave absorbing material, comprising:

first electrically conductive non-magnetic fibers, which are substantially straight and have a unique predetermined length, diameter and volume, for collectively producing a first predetermined permittivity;

second electrically conductive non-magnetic fibers, which are substantially straight and have a unique predetermined length, diameter and volume, for collectively producing a second predetermined permittivity; and a relatively low loss dielectric binder for binding a light loading of said first electrically conductive non-magnetic fibers and said second electrically conductive non-magnetic fibers into said electromagnetic wave absorbing material, such that said first and second electrically conductive non-magnetic fibers are randomly oriented and uniformly distributed throughout the volume of the dielectric binder in a single layer, wherein said electromagnetic wave absorbing material includes a composite complex permittivity that makes the material capable of absorbing a broadband of frequencies.

2. An electromagnetic wave absorbing material according to claim 1 which further includes a light loading of third electrically conductive non-magnetic fibers, which are substantially straight and have a unique predetermined length, diameter and volume, for collectively producing a third predetermined permittivity, said third electrically conductive non-magnetic fibers being randomly oriented and uniformly distributed throughout the volume of the dielectric binder in the single layer.

3. An electromagnetic wave absorbing material according to claim 1 wherein the material absorbs radar waves.

4. An electromagnetic wave absorbing material according to claim 3 wherein the first electrically conductive fibers collectively produce a Debye permittivity and the second electrically conductive fibers collectively produce a Lorentz permittivity.

5. An electromagnetic wave absorbing material according to claim 3 wherein the first electrically conductive fibers collectively produce a Lorentz permittivity and the second electrically conductive fibers collectively produce a different Lorentz permittivity.

6. An electromagnetic wave absorbing material according to claim 3 wherein the first electrically conductive fibers collectively produce a Debye permittivity and the second electrically conductive fibers collectively produce a different Debye permittivity.

7. An electromagnetic wave absorbing material according to claim 3 wherein the second electrically conductive fibers are relatively conductive and the first electrically conductive fibers are relatively resistive in comparison to the second electrically conductive fibers.

8. An electromagnetic wave absorbing material according to claim 7 wherein said first electrically conductive fibers are graphite fibers and said second electrically conductive fibers are metal coated graphite fibers.

9. An electromagnetic wave absorbing material according to claim 8 wherein the first electrically conductive fibers are selected from the group consisting of T300 graphite fibers and AS-4 graphite fibers.

10. An electromagnetic wave absorbing material according to claim 8 wherein the metal mating for the second electrically conductive fibers is selected from the group consisting of nickel, stainless steel, or copper.

11. A method of designing an electromagnetic wave absorbing material, comprising the steps of:

selecting first electrically conductive non-magnetic fibers, which are substantially straight and have a unique predetermined length, diameter and volume, which collectively produce a first predetermined permittivity;

selecting second electrically conductive non-magnetic fibers, which are substantially straight and have a unique predetermined length, diameter and volume, which collectively produce a second predetermined permittivity; and combining a light loading of said first electrically conductive non-magnetic fibers and said second electrically conductive non-magnetic fibers into a low loss dielectric binder to produce said electromagnetic wave absorbing material, such that said first and second electrically conductive non-magnetic fibers are randomly oriented and uniformly distributed throughout the volume of the dielectric binder in a single layer, wherein said electromagnetic wave absorbing material includes a composite complex permittivity that makes the material capable of absorbing a broadband of frequencies.

12. A method according to claim 11 which further includes the steps of selecting third electrically conductive non-magnetic fibers, which are substantially straight and have a unique predetermined length, diameter and volume, which collectively produce a third predetermined permittivity and combining the third electrically conductive non-magnetic fibers which are randomly oriented and uniformly distributed throughout the volume of the dielectric binder in the single layer.

13. A method according to claim 11 wherein the material absorbs radar waves.

14. A method according to claim 12 wherein the first electrically conductive fibers collectively produce a Debye permittivity and the second electrically conductive fibers collectively produce a Lorentz permittivity.

15. A method according to claim 12 wherein the first electrically conductive fibers collectively produce a Lorentz permittivity and the second electrically conductive fibers collectively produce a different Lorentz permittivity.

16. A method according to claim 12 wherein the first electrically conductive fibers collectively produce a Debye permittivity and the second electrically conductive fibers collectively produce a different Debye permittivity.

17. A method according to claim 12 wherein the second electrically conductive fibers are relatively conductive and the first electrically conductive fibers are relatively resistive in comparison to the second electrically conductive fibers.

18. An electromagnetic wave absorbing material according to claim 1 wherein the first and second electrically conductive fibers are substantially cylindrical.

19. An electromagnetic wave absorbing material according to claim 2 wherein the first, second and third electrically conductive fibers are substantially cylindrical.

20. A method according to claim 11 wherein the first and second electrically conductive fibers are substantially cylindrical.

21. A method according to claim 12 wherein the first, second and third electrically conductive fibers are substantially cylindrical.

* * * * *